United States Patent [19]

Garner

[11] Patent Number: 4,896,404

[45] Date of Patent: Jan. 30, 1990

[54] CLOSURE DEVICE FOR ARTIFICIAL TURF SECTIONS

[75] Inventor: Bernard L. Garner, St. Louis, Mo.

[73] Assignee: Astroturf Industries, Inc., Dalton, Ga.

[21] Appl. No.: 316,508

[22] Filed: Feb. 27, 1989

[51] Int. Cl.[4] ..... A44B 19/26

[52] U.S. Cl. ..... 24/415; 24/416

[58] Field of Search ..... 24/415, 416, 417, 418; 273/27

[56] References Cited

U.S. PATENT DOCUMENTS

| | | | |
|---|---|---|---|
| 1,977,528 | 10/1934 | Puc | 24/416 |
| 2,181,625 | 11/1939 | Mucci et al. | 24/416 |
| 2,790,224 | 4/1957 | Mercer | 24/416 |

FOREIGN PATENT DOCUMENTS

| | | | |
|---|---|---|---|
| 0736327 | 9/1955 | United Kingdom | 24/416 |

*Primary Examiner*—Victor N. Sakran

*Attorney, Agent, or Firm*—Needle & Rosenberg

[57] ABSTRACT

A device for joining juxtaposed sections of artificial turf having rows of interlockable elements disposed along opposed edges of the turf sections, having a first body member having a first head portion and a first handle connected about one of its ends to the first head portion, and a second body member having a second head portion and a second handle connected about one of its ends to the second head portion. The first and second head portions are selectively movable into and out of spaced apart overlying relationship by manipulating the handles. Guide means are provided on at least one of the first and second head portions and form means for guiding the interlockable elements into engaged and disengaged relationship when the first and second head portions are in overlying relationship.

9 Claims, 2 Drawing Sheets

CLOSURE DEVICE FOR ARTIFICIAL TURF SECTIONS

BACKGROUND OF THE INVENTION

The present invention relates to closure devices, and more particularly to an improved closure device for joining juxtaposed sections of artificial turf.

Artificial turf-covered playing surfaces are typically comprised of numerous sheets of artificial turf joined along their edges. For example, a standard size football field is commonly comprised of 25 to 28 individual turf sections each measuring approximately five yards in width and seventy yards in length. It is important that the individual turf sections be securely joined since unconnected sections of turf make a poor appearance and pose a potential hazard for athletes playing on the surface.

It has also become commonplace to customize field appearances depending on events. For example, a single football end zone may have the insignia of a college team on a Saturday and a professional team on a Sunday. This is done by selectively joining different end-zone interior sections into the field.

One popular method of joining together sections of artificial turf is the use of interlockable engagement means, such as toothed or coiled zippers. The zippers have opposed strings or rows of interlockable elements or "teeth" which are brought into interlocking engagement by the movement of a slide fastener in one direction along the rows and are disengaged by movement of the fastener in an opposite direction. The slide fastener is engaged to the teeth at one end of the row and disengaged from the teeth at the opposite end, often 70 or more yards away from the beginning.

The use of zippers to connect turf sections, however, has, many problems. The zippers on a playing surface are subjected to tremendous amounts of physical punishment, such as being stepped upon by cleated shoes, run over by vehicles, and exposed to harsh weather conditions. Also, the zippers tend to become clogged with dirt and other substances during an event. Furthermore, because the markings on a playing surface are typically removed with ammonia, plastic, rather than brass or other metallic teeth, must be used. As a result, the zipper teeth quite often break or become otherwise disengaged.

It is very difficult to re-engage broken teeth, particularly when they are located near the middle of a field. Presently known slide fasteners cannot travel over the teeth, and typically, in order to replace a small length of zipper, the entire zipper must be detached from both juxtaposed edges of turf and a new zipper must be sewn onto the turf. Furthermore, if no teeth are broken and the sections merely become unjoined at some portion, it is presently necessary to draw the slide fastener across the entire length of the field. These limitations inherent in currently-used slide fasteners add greatly to the cost of maintaining an artificial turf playing field.

There exists a need, therefore, for an improved device for joining juxtaposed sections of artificial turf.

There exists a further need for such a device which eliminates the necessity of drawing a slide fastener the entire length of a turf section when only a small portion needs to be joined.

SUMMARY OF THE INVENTION

The above disadvantages are overcome by the present invention which relates to a device for joining juxtaposed sections of artificial turf having rows of interlockable elements disposed along opposed edges of the turf sections. For example, the device may be used to close a standard zipper assembly comprised of a stringer connected to the turf edge and having interlockable "teeth".

In its preferred embodiment, the device includes a first body member and a second body member. The first body member has a flat, rectangular first head portion and a handle extending diagonally from the first head portion. The second body member similarly has a flat, rectangular second head portion and a handle extending from the second head portion. The head portions and handles are preferably substantially complimentary in appearance to each other so that the two body members can be placed into overlying relationship with each other. The handles are pivotally attached to each other at their respective distal ends (the ends opposite their respective head portions) so that the body members can be moved into and out of overlying relationship.

Means for guiding the interlockable elements, such as zipper teeth, into engage and disengaged relationship are formed between the head portions when the head portions are moved into overlying relationship. Preferably, the guiding means includes a center guide member extending upwardly from one of the head portions and contacting the other head portion when in overlying relationship to maintain a space between the head portions. The guide means also comprises a pair of side guide members which extend upwardly from one of the head portions a distance less than that of the center guide member and which provides a common passage therebetween. The center guide member is disposed between the side guide members so that a pair of slide ports are formed on each side thereof. Furthermore, a side slot is formed between each side guide member and the overlying head portion, with the side slots being deep enough to hold the turf edges, or stringers.

In operation, the first head portion is placed beneath the turf section so that the interlockable elements are between the guide members. The second head portion is moved into overlying relationship with the first head portion until the second head portion contacts the center guide member, and the guiding means are formed. In this way, the turf edges, or stringers, are held within the side slots. Upon movement of the device in one direction, the interlockable elements are selectively engaged so that the turf sections are joined together; movement of the device in the opposite direction causes disengagement of the elements.

The present device may be used to join entire lengths of turf. For example, on a football field, the operator may move the device from one side line to the next. The ease with which the device may be placed around the interlockable elements and moved along the turf edges greatly decreases the time and expense necessary for applying artificial turf surfaces. Also, it is very unlikely that an operator will use the device in an upside down or otherwise wrong position and thereby damage the interlockable elements.

The present device may also be used to join open lengths of turf located between the ends of the field. To do this, the first head may be placed beneath the beginning portion of the unjoined length, and the second head placed in overlying relationship with the first head so that the disengaged interlockable elements are held within the aligning means. The device is then moved along the unjoined length, leaving only a small length of interlockable elements disengaged, through which the first head portion is removed.

It should be apparent that the present device eliminates the need to replace interlockable elements across an entire length of turf section when only a small number of such elements are broken. If a great number of elements are broken, a length of elements, including a stringer section, may be removed and new a length spliced into the turf section as a replacement. The device may then be used to join the entire length of the turf sections, including that having the replacement elements. Furthermore, the device is particularly useful in joining interior sections of turf, such as end zone and insignia sections, into a surrounding field.

It is, therefore, an object of the present invention to provide an improved device for joining adjacent sections of artificial turf.

It is also an object of the present invention to provide such a device which eliminates the necessity of drawing a slide fastener the entire length of a turf section when only a small portion is to be joined.

DETAILED DESCRIPTION OF THE INVENTION

Figure 1:
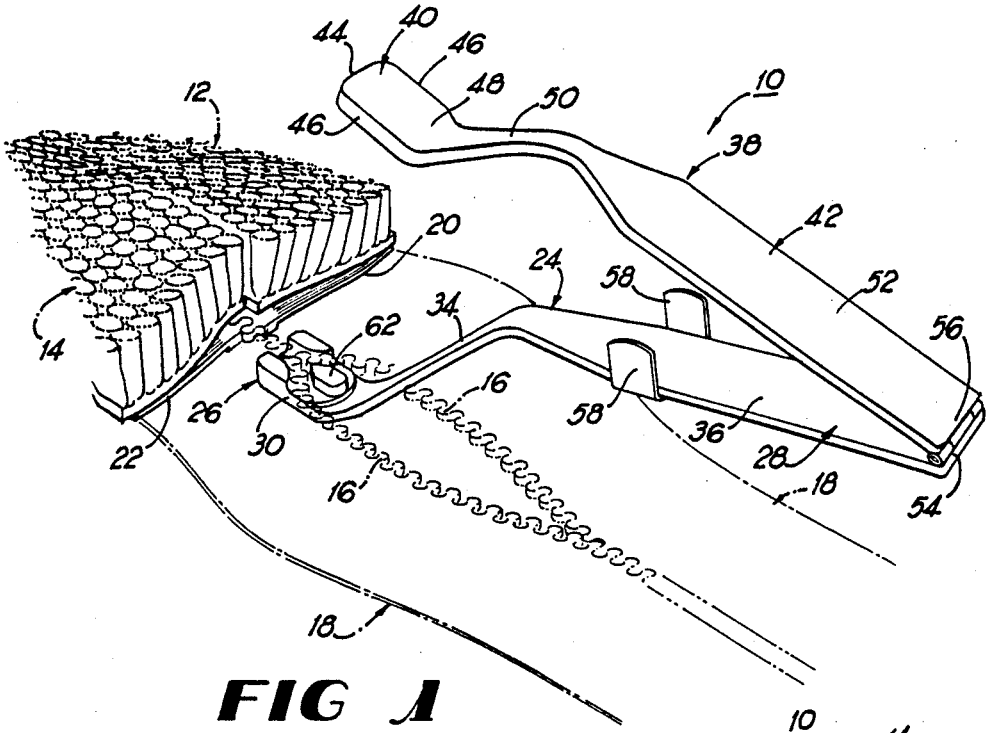
FIG. 1 is a perspective view of the device of the present invention in operation.
Figure 2:
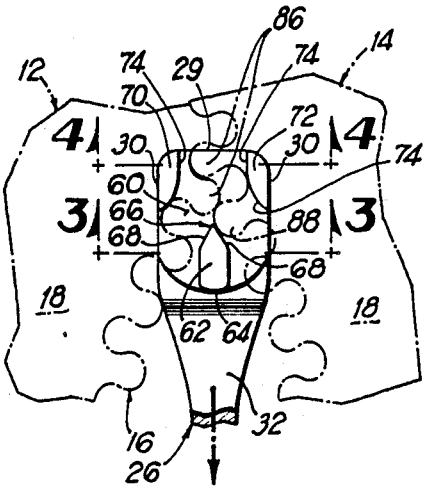
FIG. 2 is a top view of the first body member of the device of the present invention in operation with the interlockable elements being shown in phantom lines.

With reference to the figures, a device 10 is provided for joining together juxtaposed sections 12,14 of artificial turf. As best seen in FIGS. 1 and 2, artificial turf sections 12,14 may be connected using a standard zipper assembly. The zipper includes interlocking elements 16, or "teeth", arranged in adjacent opposing rows in a conventional manner along the respective edges of flexible supporting sheets or "stringers" 18. The stringers 18 are connected along the opposed edges 20,22 of the turf sections 12,14.

Figure 5:
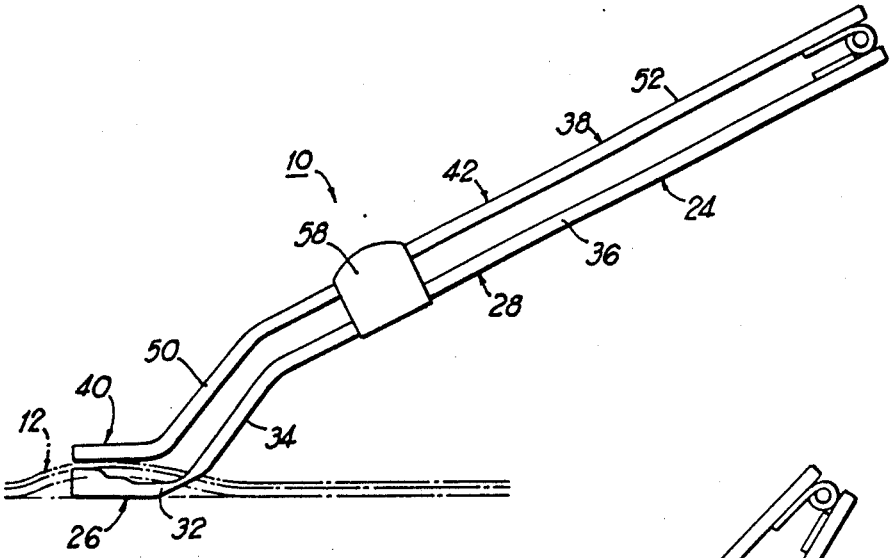
FIGS. 5 and 6 are side elevational views of the device of the present invention in operation with the turf section being shown in phantom lines.

The device preferably comprises a first body member 24 pivotally joined at its end to a complimentary shaped second body member 38. Referring to FIGS. 1 and 2, the first body member 24 comprises a first head portion 26 and a first handle 28. The first head portion 26 is flat and rectangular, and has a rearward edge 29, a pair of parallel side edges 30 and a forward portion 32 to which the handle 28 is connected. As best seen in FIG. 5, the handle 28 includes a neck section 34 integral with the forward portion 32 and disposed at an angle of approximately 45° to the first head portion 26. The handle 28 also includes gripping section 36 attached to the neck section 34 and disposed at an angle of approximately 30° to the first body member 24. Also, the widths of the first head portion 26 and the neck section 34 are each less than that of the gripping section 36 to allow proper access of the device 10 amongst the interlockable elements 16.

Like the first body member 24, the second body member 38 comprises a second head portion 40 and a second handle 42. The second head portion 40 is flat and rectangular, and has a rearward edge 44, a pair of parallel side edges 46 and a forward portion 48 to which the second handle 42 is connected. The second handle 42 includes a neck section 50 integral with the forward portion 48 and disposed at angle of approximately 45° to the second head portion 40. The second handle 42 also includes a gripping section 52 attached to the neck section 50 and disposed at an angle of approximately 30° to the second head portion 40. Also, the widths of the second head portion 40 and the neck section 50 are each less than that of the gripping section 52.

The first and second handles 28,42 are hingedly attached to each other about their respective distal ends 54,56,80 that the second body member 38 may be brought into and out of overlying or overlapping relationship with the first body member 24. When the members 24,38 are in their operational positions, the second head portion 40 is in overlying relationship with the first head portion 26. Means for maintaining the second body member 38 in overlying relationship with the first body member 24 may include a pair of tabs 58 extending upwards from the opposite sides of the first body member 24.

The device 10 has guide means for guiding the interlockable elements 16 into either engaged or disengaged relationship when the first and second head portions 26,40 are in overlying relationship. As seen in the embodiment illustrated in Figs. 1 and 2, a center guide member 62 extends upwardly from the flat top surface 60 of first head portion 26 at a location near the center of the forward portion 32 of the first head portion 26. The center guide member 62 preferably has a forward face 64 directed towards the forward portion 32, and a rearward face 66 directed towards the rearward edge 29. The rearward face 66 has a pair of concave surfaces 68 converging at a common middle point.

A pair of side guide members 70,72 extend upwardly from the surface 60, each side guide member 70,72 being positioned along each side edge 30 of the first head portion 26 and adjacent to the rearward edge 29 of the first head portion 26. Each side guide member 70,72 has a convex face 74 directed toward the center guide member 62, with a common passage being formed between the side guide members 70,72. The height of each side guide member 70,72 is less than that of the center guide member 62.

Figure 3:
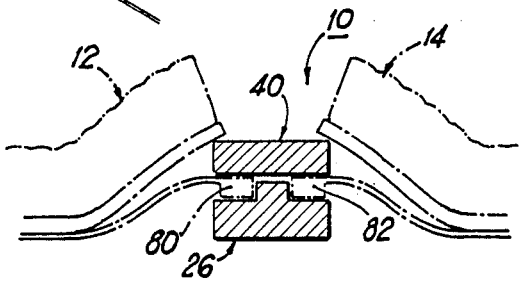
FIG. 3 is an end view of the device of the present invention in operation taken along line 3—3 in FIG. 2.
Figure 4:
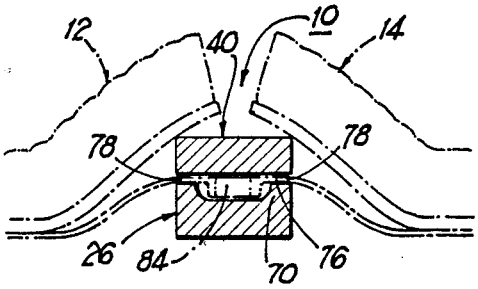
FIG. 4 an end view of the device of the present invention in operation along line 4—4 in FIG. 2.

The second head portion 40 has a substantially flat inner surface 76, as seen in FIGS. 3 and 4, which, when the body members 24,38 are in overlying relationship, contacts the center guide member 62 and thereby completes the guiding means. Because the side guide members 70,72 are shorter than the center guide member 68, a side slot 78 will be formed between the top of each side guide member 70,72 and the second head portion 40. Furthermore, as seen in FIG. 4, a pair of forward slide ports 80,82 are formed and are directed toward the forward portions 32 48 of the head portions 26,40. The first forward slide port 80 is defined between a first side guide member 70 and the center guide member 62, with the second forward slide port 82 being located between a second side guide member 72 and the center guide member 62. Also, as seen in FIG. 3, a rearward slide port 84 is formed between the side guide member 70,72 and opens to the rearward edge 29 of the first head portion 26

The device 10 may be used to join juxtaposed turf sections 12,14 beginning at the periphery of a field or to repair a disengaged length of interlockable elements 16 appearing near the middle of a field, as shown in FIG. 1. In the operation of the device 10, the body members 24,38 are separated and the first head portion 26 is placed beneath the turf sections 12,14 so that the guiding means are positioned at the beginning of the rows of interlockable elements 16 to be engaged. As shown in FIG. 2, the interlockable elements 16 are placed into the guiding means so that the end-most engaged elements 86 are between the side guide members 70,72 in the common passage and the foremost unengaged elements 88 are positioned between the side guide members 70,72 and the center guide member 62.

Once the interlockable elements 16 have been placed between the guide members 62,70,72, the second body member 38 is pivoted down onto the first body member 24 so that the second head portion 40 is in overlying relationship with the first head portion 26. As shown in FIGS. 3, 4 and 5, the second head portion 40 will rest upon the center guide member 62, and the stringers 18 will lie within the side slots 78. It is preferable that the portion of each stringer 18 nearest the interlockable elements 16 be free from its respective turf section 12,14 to provide space for allowing the second head portion 40 to be placed directly atop the first head portion 26 and moved over the element 16.

To engage the interlockable elements 16, the operator holds the handles 28,42 together at the gripping sections and moves the device 10 in a direction towards the unengaged elements (i.e., the direction of the arrow A in FIG. 2). The upwardly directed position of the handles 28,42 allows the operator to readily pull the device 10 in the desired direction. As the device 10 is moved, the interlockable elements 16 in the opposed rows enter their respective forward slide ports 80,82, as shown in FIG. 4, and the stringers 18 pass through their respective side slots 78. As the interlockable elements 16 pass between the head portions 26,40, the individual elements 16 are progressively brought into interlocking engagement and the engaged elements 16 leave the head portions 26,40 through the rearward slide port 84, as shown in FIG. 3.

Figure 6:
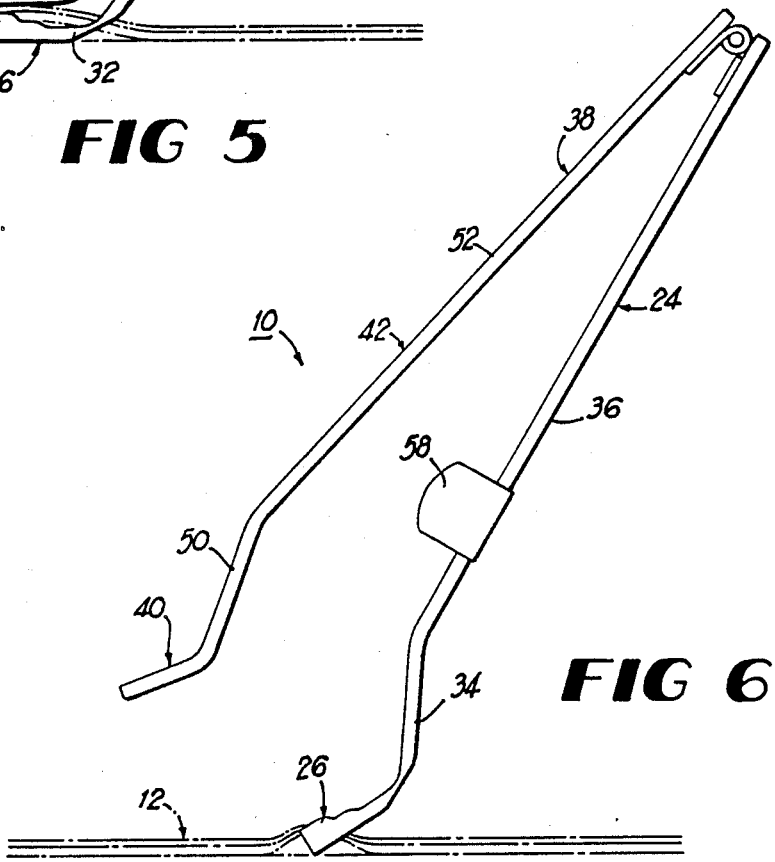

When used to join a length of interlocking elements 16 near the middle of a field, the device 10 is moved forward until only a small number of interlockable elements 16 remain disengaged, thereby maintaining a space through which the first head portion 26 may be removed from beneath the turf sections 12,14, as seen in FIG. 6. It is for this reason that the head portions 26,40 and neck sections are made narrow. When joining an entire length of field, (i.e. from side line to side line), the device 10 is simply moved forward from one end of the stringers 18 until it passes over the last interlocking elements 16 and is removed. The device 10 can be used in a similar manner, but in reverse direction, to disengage the interlockable elements 16.

Those skilled in the art will appreciate from the foregoing description that the present device will provide the ability to easily join together sections 12,14 of turf regardless of where the disengagement is located.

The present invention contemplates various modifications and alternative embodiments. For example, one or more of the guide members 62,70,72 of the guiding means may be placed on the second head portion 40 and brought to rest upon the first head portion 26. Also, the shapes of the handles 28,42 are not limited to the described embodiment, but may be any shape which allows proper handling of the device 10. However, the angles provided in the above-described embodiment have been found to provide very efficient handling of the device 10 during operation. Other modifications and alternative embodiments are within the spirit and scope of the present invention as defined by the appended claims.

Furthermore, the present invention may be used in applications other than those relating to artificial turf. The invention may be used whenever relatively lengthy sections of interlockable elements are to be engaged or disengaged.

What is claimed is:

1. A device for joining juxtaposed sections of artificial turf having rows of interlockable elements disposed along opposed edges of said turf sections, comprising:

(a) a first body member comprising a first head portion and a first handle connected about one of its ends to said first head portion;

(b) a second body member comprising a second head portion and a second handle connected about one of its ends to said second head portion, said first and second head portions being selectively movable into and out of spaced apart overlying relationship by means of manipulating said handles; and (c) guide means provided on at least one of said first and second head portions for guiding said interlockable elements into engaged and disengaged relationship when said first and second head portions are in overlying relationship.

2. The device of claim 1, wherein said guiding means comprise:

(a) a center guide member extending upwardly from one of said head portions to contact said other head portion when in overlying relationship to maintain a space between said head portions;

(b) a pair of side guide members extending upwardly from one of said head portions a distance less than said center guide member, said center guide member being disposed between said side guide members when said first and second head portions are in overlying relationship for defining first and second slide ports on opposite sides of said center guide member and further defining a side slot between each side guide member and said second head portion through which said edges of said turf section may pass; said first and second slide ports leading to a common passage between said side guide members wherein said interlocking elements are selectively engaged or disengaged upon movement of said device.

3. The device of claim 1, wherein said first and second handles extend in a common direction diagonal to the first and second head portions when said first and second head portions are in overlying relationship.

4. The device of claim 1, wherein said first handle is pivotally joined to said second handle.

5. The device of claim 1, wherein said first handle has a distal end opposite said first head portion and said second handle has a distal end opposite said second head portion, and wherein said first handle distal end is pivotally joined to said second handle distal end.

6. The device of claim 2, wherein said center guide member and said side guide members are located on a common head portion.

7. The device of claim 1, wherein said first handle comprises a first neck section integral with and extending diagonally from said first head portion and a first gripping section attached to said first neck section and said second handle comprises a second neck section integral with and extending diagonally from said second head portion and a second gripping section attached to said second neck section.

8. The device of claim 7, wherein said first and second head portions and said first and second neck portions are narrower in width than said first and second gripping sections.

9. The device of claim 1, and further comprising means for maintaining said second body member in overlying relationship with said first body member.

* * * * *